US005366018A

United States Patent [19]

Van Steenwyk et al.

[11] Patent Number: 5,366,018

[45] Date of Patent: Nov. 22, 1994

[54] MINIATURE ROPE SOCKET ASSEMBLY FOR COMBINED MECHANICAL AND ELECTRICAL CONNECTION IN A BOREHOLE WIRELINE

[75] Inventors: Donald H. Van Steenwyk, San Marino; Raymond W. Teys, Pismo Beach, both of Calif.

[73] Assignee: Scientific Drilling International, Houston, Tex.

[21] Appl. No.: 106,441

[22] Filed: Aug. 16, 1993

[51] Int. Cl.[5] ..... E01B 23/00; H01R 13/00

[52] U.S. Cl. ..... 166/385; 166/65.1; 439/578

[58] Field of Search ..... 166/385, 65.1; 439/578, 439/585, 98

[56] References Cited

U.S. PATENT DOCUMENTS

| | | | |
|---|---|---|---|
| 5,131,464 | 7/1992 | Lenhart et al. | 166/65.1 |
| 5,141,051 | 8/1992 | Lenhart | 166/65.1 |
| 5,201,814 | 4/1993 | Kitchell et al. | 166/65.1 |
| 5,205,761 | 4/1993 | Nilsson et al. | 439/578 |
| 5,295,864 | 3/1994 | Birch et al. | 439/578 |

OTHER PUBLICATIONS

"1-7/16" O.D. Cablehead Assembly Single-Conductor (Cone Type)", Gearhart, General Product Catalog, fifth edition, p. 7/5. & SIE Wireline Products p. SIE-185.

"1 7/16 60 Type Cablehead Assembly", Applied Electronic Systems, Inc. pp. ASS-002 & ASS-003.

"1" OD Cablehead Assembly", Pengo Industries, Inc., Aug. 1981, p. CCL 3.1.

"1 7/16" Cablehead Assembly (Clamp Ring Type)", Titan Specialites, Inc., p. A-6.

*Primary Examiner*—William P. Neuder

*Attorney, Agent, or Firm*—William W. Haefliger

[57] ABSTRACT

A rope socket assembly for making a combined electrical and mechanical connection in a wireline having an inner electrical conductor, a coaxial insulation layer about the conductor, and an outer protection wire covering about the insulation layer for survey, steering or logging use in a borehole, the wireline having opposite end portions and associated inner conductor end portions comprising a rope socket housing having a bore to receive the opposite end portions of the wireline; two tubular threading plugs positioned in the bore for receiving the respective end portions of the wireline; two sleeves positioned in the bore to extend about the respective plugs; and an insulator block received in the bore between the sleeves, and structure within the block for establishing electrical connection between the inner conductor end portions associated with the wireline end portions.

27 Claims, 5 Drawing Sheets

MINIATURE ROPE SOCKET ASSEMBLY FOR COMBINED MECHANICAL AND ELECTRICAL CONNECTION IN A BOREHOLE WIRELINE

BACKGROUND OF THE INVENTION

This invention relates generally to electrical connections in boreholes, and more particularly to an improved mechanical and electrical connection in a wireline used in a borehole.

Wirelines having an inner electrical conductor, a coaxial insulation layer, and an outer protective wire covering are in common usage in boreholes for connecting subsurface survey, steering or logging tools, or other subsurface electrical equipment to surface electrical equipment. Such wirelines are generally routed through a pulley or sheave at the upper level of a drilling rig, and then spooled on a reel in the wireline surface unit. From the reel, wiring connects the wireline conductor or conductors to other surface equipment.

In various situations, it becomes necessary to have a means for making a quick mechanical and electrical connection in such a wireline to either connect two wireline segments together or to connect a wireline to one or more items of subsurface equipment. Combined mechanical and electrical connectors for such wirelines in borehole usage are generally referred to as "rope socket assemblies". Such connectors must be easy to make-up to reduce costs, due to lost time; they must be mechanically very strong, providing breaking tensile strengths near or in excess of the wireline itself; and the electrical connection must be well isolated from the drilling medium or other borehole fluid material to prevent shorting of the inner electrical conductor to the outer protective wire covering.

Previous design practices have resulted in rope socket assemblies that are generally large in diameter, compared to the wireline diameter, and quite long. Typical units have been on the order of 1.375 inches in diameter and larger, and 12 or more inches in length, for a typical 5/16 inch diameter wireline, for example. Further, the sealing means to isolate the electrical connection from fluids in the borehole have shown limited reliability; and their size has contributed to the overall size of existing rope socket assemblies.

The large, overall dimensions for existing technology rope socket assemblies have made it impossible to route such assemblies through the pulley or sheave at the upper levels of a drill rig, or to retrieve and wind the wireline onto the reel in the wireline surface unit. These restrictions often require the cutting or mechanical removal of such rope socket assembly components from the wireline each time the wireline must be retrieved from the borehole. This requirement leads to increased costs of operation, not only upon the retrieval of a wireline, but also upon the reinsertion of the wireline into the borehole, since the connections must be remade as the wireline is traversed into the borehole. Accordingly, there is great need for improved apparatus obviating the above difficulties and restrictions.

SUMMARY OF THE INVENTION

It is a major object of the invention to provide a miniature rope socket assembly for wireline use that is small enough to permit passage through the open pulley or sheave, small enough to be directly wound and unwound from the wireline reel, and also characterized as having more reliable sealing means to protect the electrical circuit from the borehole fluids.

In one embodiment, the diameter of a rope socket assembly of this invention is reduced from the previously cited diameter, to no more than about 1.0 inches; and the length of the new assembly is reduced from the previously cited length to less than 5.5 inches, for example between divergent end walls of the housing. The total volume of the improved rope socket assembly is reduced from over 18 cubic inches to less than 4.2 cubic inches. That 18 cubic inch size of conventional assemblies is an indication of the difficulty in winding a rope socket assembly onto a wireline reel.

Further objects of this invention include reduction in the cost of usage of connectors in wirelines by eliminating the requirements for removal and replacement of such connecting elements, as the wirelines with connectors are run into and retrieved from boreholes, and the achievement of higher reliability through improved sealing means.

In prior practice, rope socket assemblies were designed on the basis of selecting a standard electrical connection, then providing some sort of insulation boot around the standard connection, and then providing an external enclosure to provide the mechanical strength required, to protect the insulation boot from the borehole environment. This practice resulted in the large size and marginal sealing cited in the background above.

The rope socket assembly of the present invention also improves over prior practice by provision of a simple insulator block with an electrically conducting tube running through it. The ends of the wireline are terminated in contact pins that are inserted into the conductor tube. Gaskets, preferably of an O-ring configuration, surround the insulation layer of each wireline end, then seal, when compressed, the wireline insulation to the body of the insulator block. The insulator block is preferably made of a high-strength material that permits exertion of a high compression on or in the gaskets without significant deformation of the block. The gaskets are compressed against the insulator block by two threading plugs, one at each end, that are connected to the wireline outer protective wire cover. These threading plugs have holes through flanges thereon that permit individual wire strands from the wireline outer wire cover to pass through them. This assures that the wire strands are adequately gripped by the threading plug and that the threading plug can be compressed on the wire strands to a final precision dimension when a threading plug sleeve contacts the threading plug body. With the precise length of the insulator block and the precise length of the two threading plugs established, the housing and cap of the rope socket assembly can then provide for a high and controlled compression transmission to the sealing gaskets.

These and other objects and advantages of the invention, as well as the details of an illustrative embodiment, will be more fully understood from the following specification and drawings, in which:

DRAWING DESCRIPTION

Figure 6A:
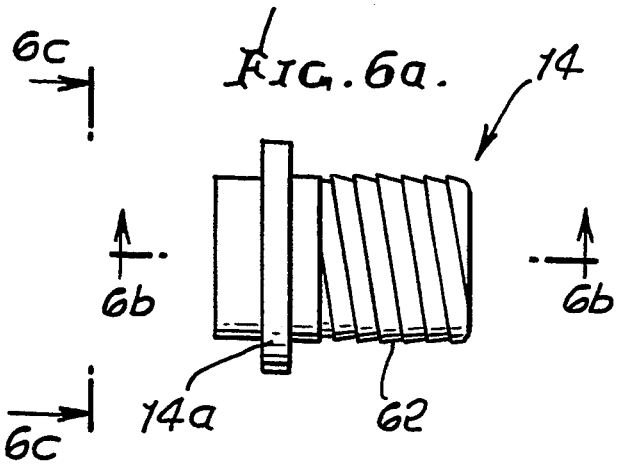
Figure 6C:
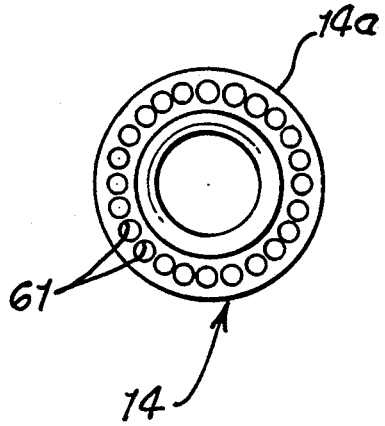
Figure 6B:
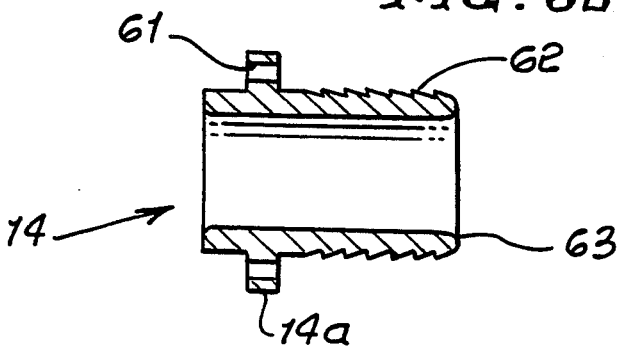

FIG. 6*a* is an elevation showing the threading plug body; FIG. 6*b* is a section taken on lines 6*b*—6*b* of FIG. 6*a;* and FIG. 6*c* is an end view taken on lines 6*c*—6*c* of FIG. 6*a;*

Figure 7B:
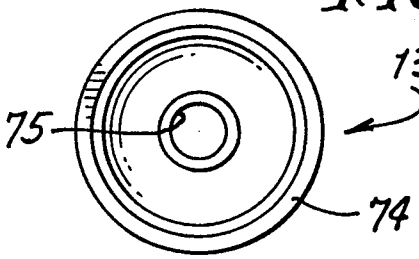
Figure 7A:
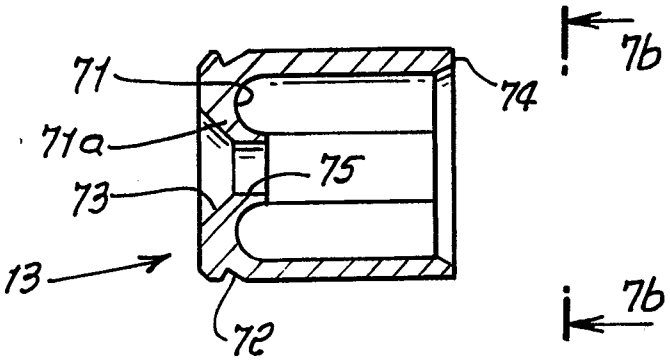

FIG. 7*a* is a cross section taken through a threading plug sleeve; and FIG. 7*b* is an end view of the threading plug sleeve taken on lines 7*b*—7*b* of FIG. 7*a;*

Figure 2:
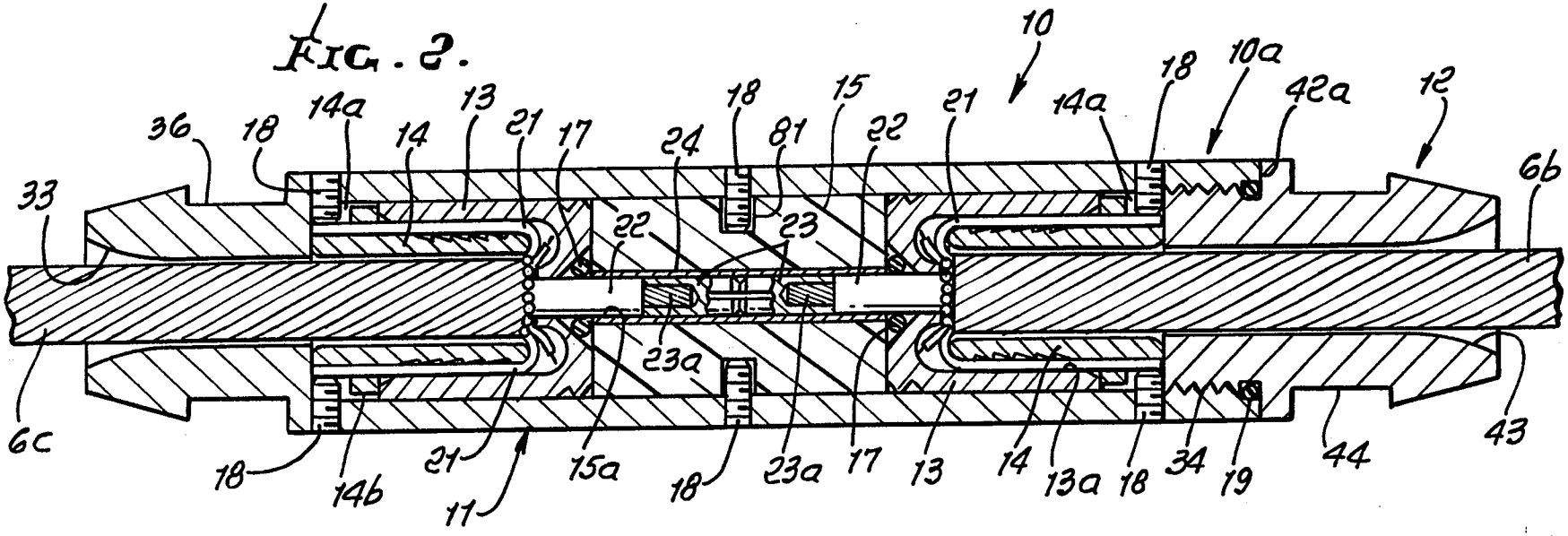
FIG. 2 is a cross section taken through the overall rope socket assembly.
Figure 10:
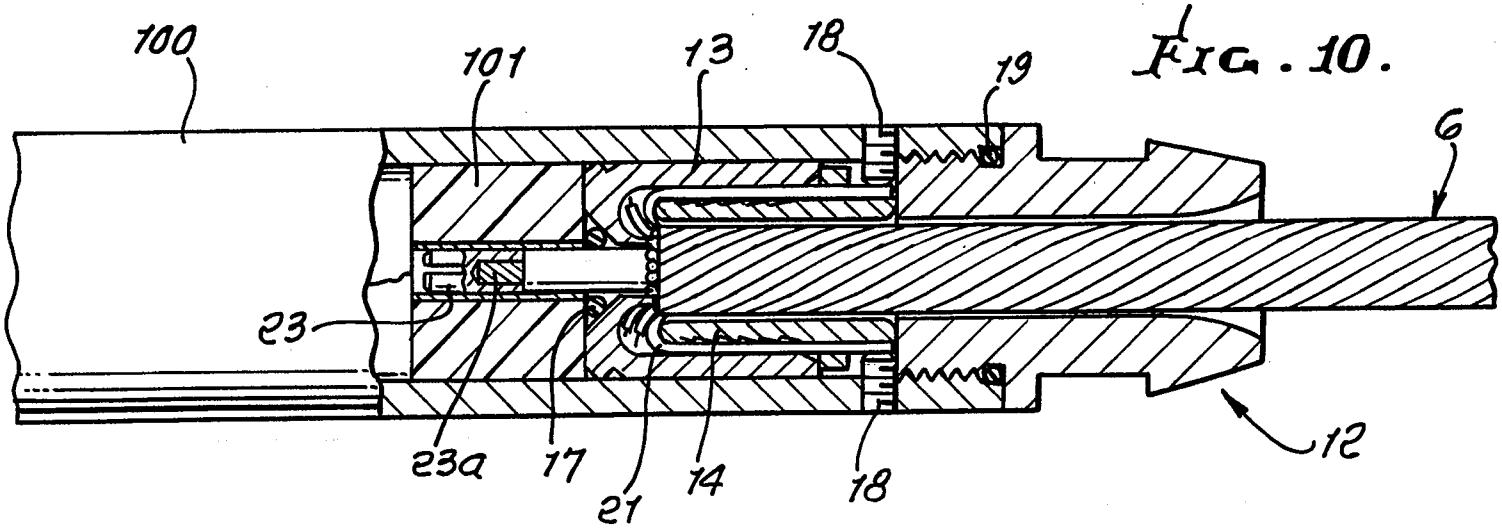
Figure 9B:
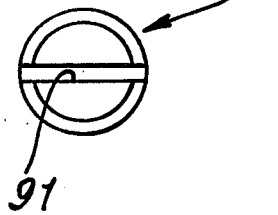
Figure 9A:
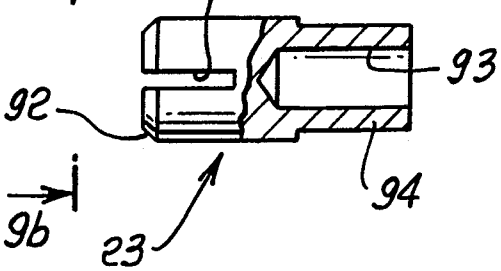
Figure 8:
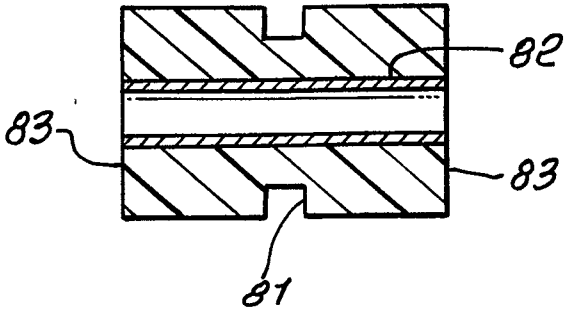

FIG. 8 is an axial cross section taken through an insulator block and a conductor tube therein;

FIG. 9*a* is an elevation, partly broken away, showing a contact pin; FIGS. 9*b* is an end view taken on lines 9*b*—9*b* of FIG. 9*a;* and FIG. 10 is a cross section like FIG. 2 showing an alternative rope socket assembly establishing connection between a wireline and a subsurface item of equipment.

DETAILED DESCRIPTION

Figure 1:
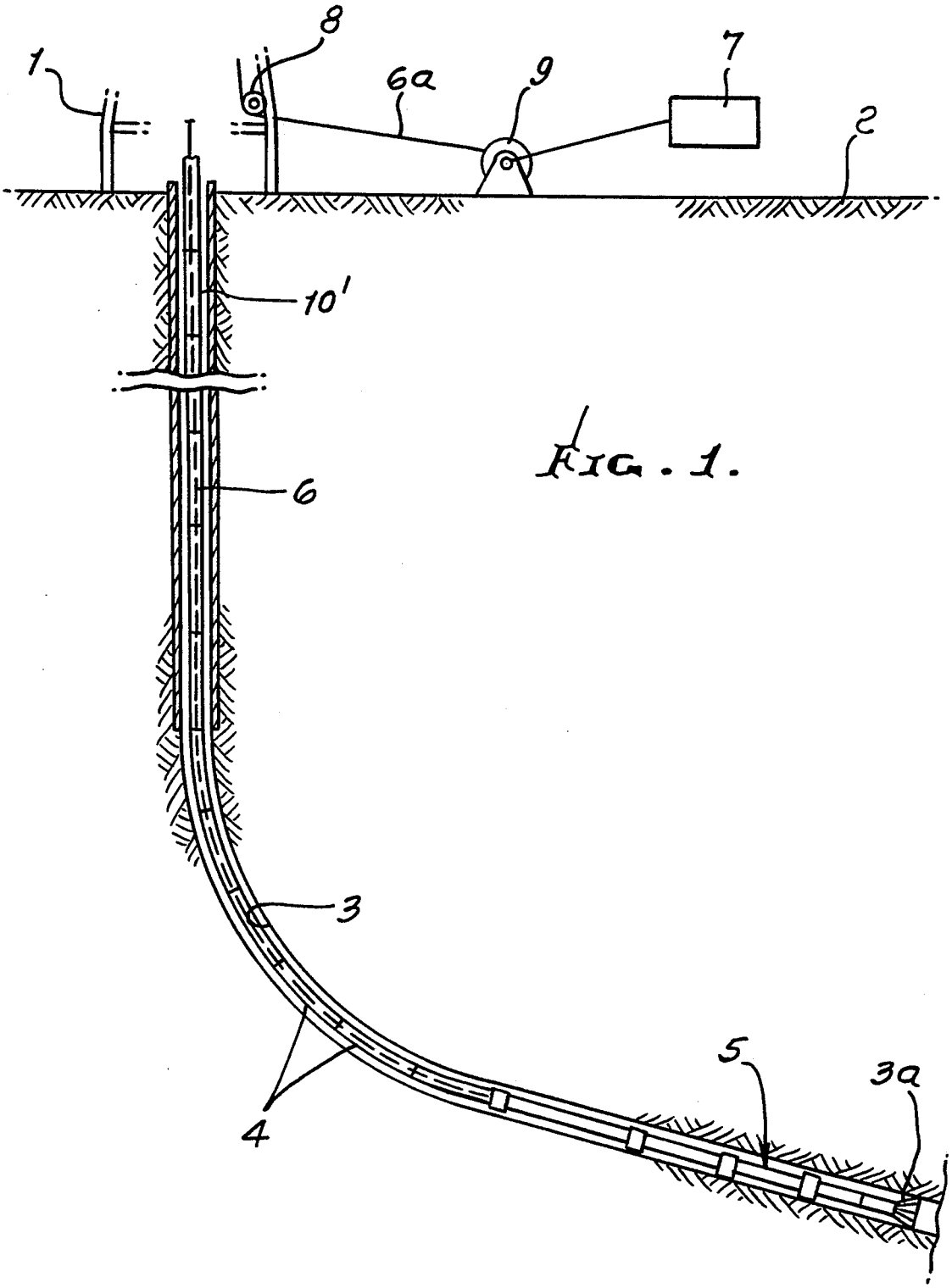
FIG. 1 is a schematic view of a borehole drilling operation showing the borehole, a wireline, and the surface wireline equipment.
Figure 1A:
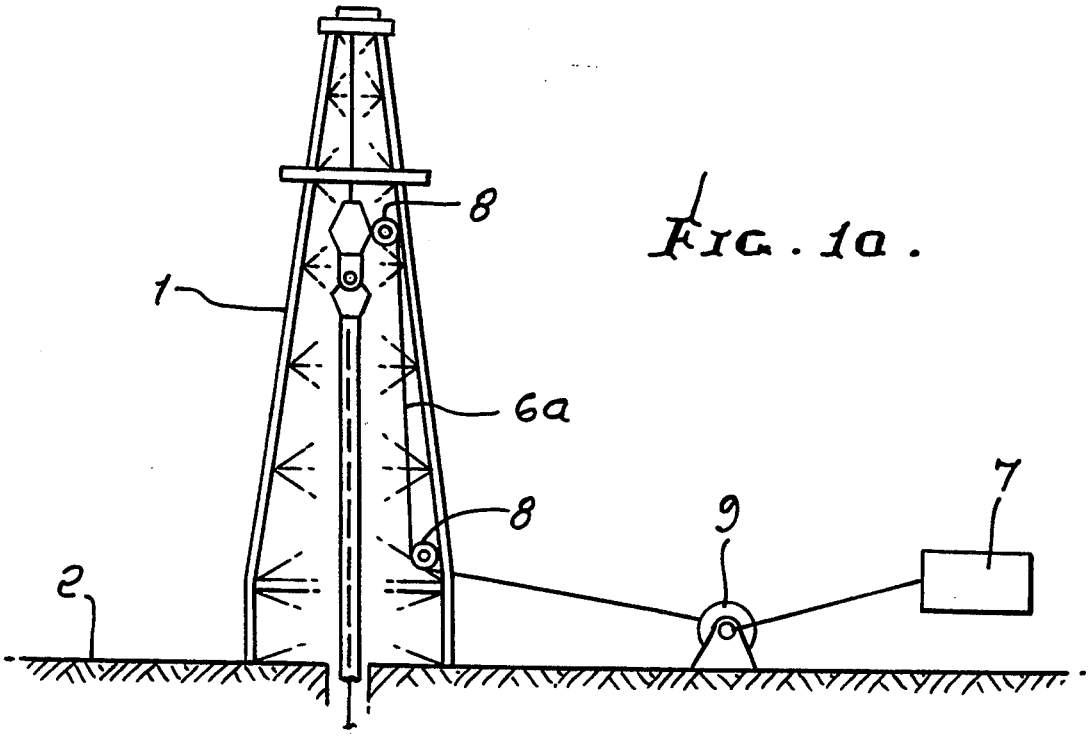
FIG. 1*a* is a view like FIG. 1 showing crown block elevation to pull a pipe string.

FIG. 1 shows a drilling rig 1 on the surface of the earth 2 for drilling a borehole 3 into the earth. The drilling is accomplished by a drill bit 3*a* at the bottom of the drilling string made up of individual drill pipe sections 4. As part of the drill bit and drill collar assembly at the bottom of the string, a survey tool 5 is provided for measuring the direction and tilt of the borehole. A wireline 6 extends upwardly through the drill pipe sections 4 and exits the hole to carry power and signal data between the sub-surface survey tool and surface equipment. The wireline 6*a* passes over pulleys or sheaves 8 associated with the rig and is spooled on a reel 9 that is generally controlled and operated by a motor drive. Reel 9 unwinds as the drill string penetrates further into the earth. The wireline 6 is wound up on reel 9 when it becomes necessary to pull the tool 5, allowing the drill string to be removed from the borehole. Surface equipment 7 is connected to the wireline.

For several purposes, it is normally required to have a connection in the wireline that may be broken and then reconnected. A rope socket assembly 10′ is shown in FIG. 1, just below the surface 2. Assembly 10′ must have sufficient mechanical strength that the strength of the wireline is not reduced, and the electrical contact established with the wireline contactor must be protected from the borehole environment, to prevent shorting of electrical power or signals that would prevent obtaining data electrically transmitted from the survey tool 5 at the bottom of the hole. Also, it is desired that the rope socket assembly travel on the pulleys and spool on the reel.

FIG. 2 shows a cross section of the improved rope socket assembly 10 meeting these requirements. Opposite end portions 6*b* and 6*c* of wireline 6 are shown entering opposite ends of the tubular housing 11 of the rope socket assembly. Each wireline end portion has its outer protective wire covering strands 21 bent back around the exterior of a tubular threading plug body 14 into which the wireline end portion projects.

The individual bent back wire strands 21 of the wireline outer protective wire covering 21*a* extend through a series of holes 61 (see FIG. 6*a*) in a flange 14*a* on the threading plug body. Each of the threading plug bodies 14 is received in a threading plug sleeve 13, the bore 13*a* of which grips the wireline outer protective wire covering strands to retain them in position between the threading plug body 14 and the sleeve 13.

The wireline coaxial insulation layers 22, exposed at the wireline end portions, extend into opposite ends of the bore 15*a* of an insulator block 15. The ends of the wireline inner and protected electrical conductors 23*a* are terminated by contact pins 23 that are crimped onto the conductors. These contact pins 23 make electrical contact to a cylindrical conductor tube 24 that extends centrally through the insulator block, providing an effective electrical conducting path from the contact pin 23 on one wireline inner electrical conductor 23*a* to the contact pin 23 on the other wireline inner electrical conductor 23*a*.

A sealing gasket 17, preferably of an O-ring configuration, is shown at each end of the insulator block 15 engaging that block end and the tapered end surface of the threading plug sleeve 13. The gasket extends about and engages the surface of layer 22. These gaskets, which become compressed when the entire assembly is screwed together between the rope socket housing 11 and the rope socket cap 12, provide effective sealing directly between the wireline coaxial insulation layer 22 and the insulator block 15, at opposite ends of the latter. Note screw threading at 34 between 11 and 12.

When these elements are screwed together, the rope socket housing 11, together with the rope socket end cap 12, control, as stated above, both the clamping force on the wireline outer protective wire covering 21*a* provided by the threading plug body 14 and the threading plug sleeve 13, and the compression force acting between the threading plug sleeves 13 and the insulator block 15 on the sealing gaskets. Note that opposite ends of the block 15 are engaged by the ends of the sleeves 13. The faces of the surfaces of these internal elements are machined accurately perpendicular to the axial direction of the parts. Also, the internal surfaces of the rope socket housing and the rope socket cap perpendicular to the axial direction are accurately machined. This permits a very good control of the clamping forces and compression forces, since all such machined surfaces come into contact over substantially their entire facing parts.

Six retainer-type set screws 18 are shown in FIG. 2 as threaded into through bores 31 in the wall 10*b* of housing receptacle 10*a*, and projecting into recesses 14*a* in the sleeves, and recesses 81 in the block 15. These are inserted after the rope socket housing and rope socket cap are screwed together at 34. They lock the total assembly in place and prevent any rotation that would tend to unscrew the assembly or allow twisting of one part with respect to another. Thus, there is no twisting force on the gasket seals 17. Also, a sealing gasket 19 may be provided between the rope socket housing and the rope socket cap, which serves to keep foreign material from the borehole environment out of the threaded area 34. This does not affect the electrical integrity of the insulation between the wireline inner conductor and the outer metal elements.

Figure 3:
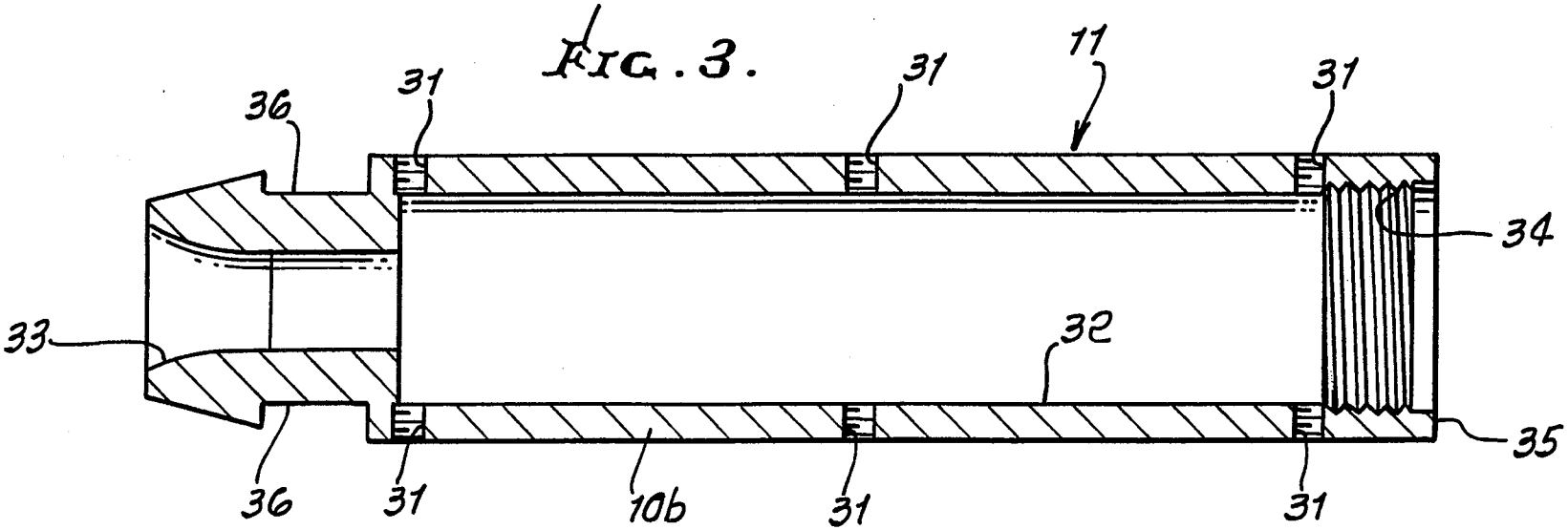
FIG. 3 is an axial cross section showing the rope socket housing.

FIG. 3 shows a detailed cross section of the rope socket housing 11, and indicates that six threaded holes 31 are provided in wall 10*b* for the set screws 18 of the assembly. The inner cylindrical surface 32 of wall 10*b* has a close mechanical fit with the outer cylindrical surfaces of the threading plug sleeves and the insulator block. This prevents any tendency of these inner elements to cock into a misaligned condition when the assembly is screwed together. The inner surface 33 at each wireline entry end of the housing is rounded (arcuately divergent), to permit the entering wireline to bend gradually to adapt to the housing without causing a high-stress condition, as during travel over a pulley or onto or off reel 9. Note similarity of opposite ends of the device. The thread 34 provides for mating with the thread of the rope socket cap. The shoulders 35, normal to the axial direction, are accurately machined, as discussed above, for axially aligned clamp-up. A set of flats 36 is provided to permit a wrench to be used to tighten the rope socket housing to the rope socket cap.

Figure 4:
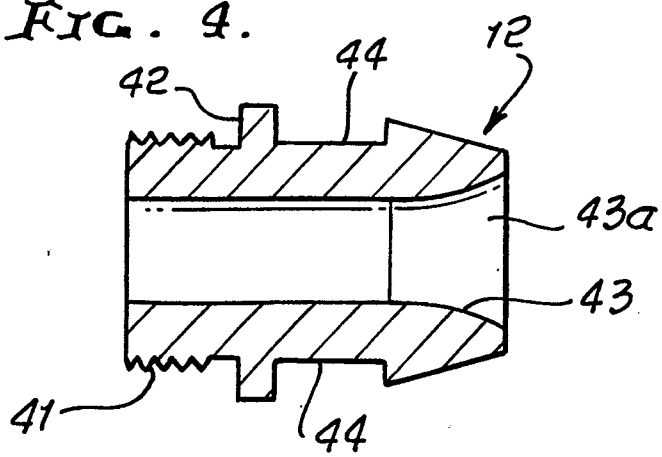
FIG. 4 is an axial cross section showing the rope socket cap.

FIG. 4 shows a cross section of one form of rope socket cap 12. It has threads 41 to match the threads 34 of the rope socket housing. The normal surface 42 is accurately machined to match the mating surface 42*a* on the housing, and thus provide aligned and controlled forces on the enclosed elements for limiting clamp-up. The inner surface 43 at mouth 43*a* is rounded (arcuately divergent) similarly to the surface 33 on the rope socket housing, to permit gradual bending of the wireline where it enters the assembly. A set of flat areas 44 is provided to permit a wrench to be used to tighten the rope socket cap to the rope socket housing.

Figure 5:
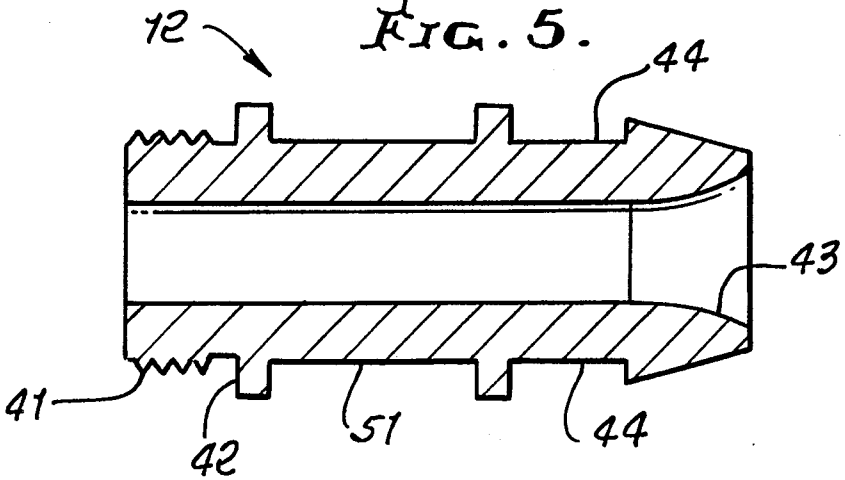
FIG. 5 is an axial cross section showing an alternative rope socket cap having provision for an overshot retrieval groove.

FIG. 5 is a cross section showing an alternative form of the rope socket cap 12. The details of this alternative are identical to those of FIG. 4, except that the cap is lengthened to provide a lengthwise groove 51 that can engage a conventional overshot tool that may be dropped into the borehole to retrieve the rope socket assembly and the wireline or subsurface item below that level. Such action may be required if the wireline were to break above or pull out of the rope socket assembly, or may be required in other special uses of the rope socket assembly.

FIGS. 6*a*, 6*b* and 6*c* show plug 14 in side view cross section and end view. A series of axial holes 61 is shown extending through the flange 14*b*. These holes permit passage of the individual wire strands of the wireline outer protective wire covering. Serrations 62 are provided on the outer surface of the body to provide added holding power when the individual wire strands from the wireline outer covering are clamped between the threading plug body and the threading plug sleeve. One end 63 of the body 14 is rounded so that the individual wire strands of the wireline outer covering can be bent around that end and back through the holes 61, without causing high stress or cutting of the wire strands, which would reduce the strength of the completed assembly.

FIGS. 7*a* and 7*b* show an end view and a cross section view of the threading plug sleeve 13. The rounded (annularly concave) inner surface 71 on flange 71*a* contacts the individual wires of the wireline outer covering that are bent around the rounded (annularly convex) end 63 of the threading plug body. A groove 72 is machined around the outer surface of the threading plug sleeve, to interfit a knock-off tool, if desired, to aid in disassembly of the threading plug components from the wireline. The sealed end surface 73 provides clearance space into which the sealing gasket 17 may be compressed upon assembly of the total rope socket connector assembly. The end surface 74, normal to the axial direction, is accurately machined to help control the clamping and compression forces for accuracy of axial clamp-up during assembly. The inner diameter 75 of the bore opening in the threading plug sleeve is accurately controlled to pass and match to the outer diameter of the wireline coaxial insulation layer so that, when the gasket 17 is compressed at assembly, it does not tend to extrude into the clearance between the sleeve and the insulation on the wireline. This assures that the compression force on the gasket will provide the desired reliable seal between the insulation layer 22 and the insulator block 15.

FIG. 8 shows a cross section of the insulator block 15. The block is made from an insulating material having excellent electrical insulation properties, mechanical strength and dimensional stability, at the elevated temperatures that may be encountered in boreholes. One suitable material is VICTREX PEEK 450GL30, available from The Polymer Corporation, P.O. Box 422, Reading, Pa. This material is a glass fiber filled polyetheretherketone. It has 30% glass fiber filling and 70% polyetheretherketone. The insulator block has an external annular groove 81 around its outer diameter that engages two set screws 18 on overall assembly. There is a cylindrical metal tube 82 (24 in FIG. 2) through the center of the insulator block, and which may be made of copper, brass or any other high conductivity metal. It provides the conductive path between the two contact pins 23 that enter and contact the tube bore from each wireline inner electrical conductor. The end surfaces 83, perpendicular to the axial direction, are accurately machined to assure proper clamping and compression forces on assembly, and to provide a good finish to assure that the sealing gaskets 17 at each end will provide the desired highly reliable seal.

FIGS. 9*a* and 9*b* show an end view and a partial cutaway section of the contact pin 23. The pin is made from copper, beryllium copper, brass, or any other high conductivity metal. The slot 91, through one end of the pin, provides a small degree of spring motion to improve contact with the conductor tube 82 when the pin is inserted with interference fit into the tube. The chamfer 92 is provided to make it easier to start the insertion of the pin into the conductor tube. The bore 93 is sized to permit a close fit around the inner electrical conductor 23*a* of the wireline. The wall thickness 94 around this bore is sized to permit deformation by a crimping tool to lock the pin in good electrical contact with the wireline inner conductor when the pin is assembled to the inner conductor.

FIG. 10 shows a cross section of the use of certain elements of the rope socket assembly described above, to make a mechanical and electrical connection between a wireline and an item of subsurface equipment, such as a steering, survey or logging tool. The same problems of mechanical strength and protection of the electrical contact from the borehole environment exist in this usage, as in the problem of connecting two pieces of wireline together. The rope socket cap 12, the threading plug body 14, the threading plug sleeve 13, the contact pin 23, and the gasket 17 are the same as those described in connection with FIGS. 2 through 9. In this usage shown in FIG. 10, the rope socket housing 11 in FIG. 2 is replaced by the outer structure 100 of the tool that is to be connected to the wireline. Also, the insulator block 15 in FIG. 2 is replaced in FIG. 10 by an insulator block 101 that is integral with the tool in structure 100. It may be sealed to that structure by any suitable means.

Referring again to FIG. 2, one typical method of assembly of the elements shown in FIGS. 3 through 9 into the completed rope socket assembly includes the steps:

1) cutting both ends of the wireline 6 to be joined squarely;
2) sliding the rope socket cap 12 over the end of the wireline segment that is to be the upper end of the assembly in the borehole with the threaded end toward the wireline end;
3) sliding the threading plug body 14 over the wireline with the flanged end toward the rope socket cap and the rounded end toward the wireline end;
4) peeling back about 1 inch of the individual wire strands 21 making up the wireline outer protective wire covering over the threading plug body and through the holes in the flange thereon;
5) sliding the threading plug sleeve 13 over the threading plug body with the open end toward the threading plug body to cover the body and the individual wire strands bent around it;
6) removing about 3/16 inch of the coaxial insulation layer 22 from the wireline end;
7) slipping the contact pin 23 over the end of the wireline inner electrical conductor and crimping it to the inner conductor with a suitable crimping tool;
8) sliding the rope socket housing 11 over the end of the wireline segment that is to be the lower end of the assembly in the borehole with the threaded end toward the wireline end;
9) sliding the threading plug body 14 over the lower wireline end with the flanged end toward the rope socket housing and the rounded end toward the wireline end;
10) peeling back about 1 inch of the individual wire strands 21 making up the wireline outer protective wire covering over the threading plug body and through the holes in the flange thereon;
11) sliding the threading plug sleeve 13 over the threading plug body with the open end toward the threading plug body to cover the body and the individual wire strands bent around it;
12) removing about 3/16 inch of the coaxial insulation layer 22 from the lower wireline end;
13) slipping the contact pin 23 over the end of the wireline inner electrical conductor and crimping it to the inner conductor with a suitable crimping tool;
14) slipping an O-ring configuration gasket 19 over the assembled threading plug and the threads of the rope socket cap 12 and into the relief beyond the threads;
15) slipping an O-ring configuration gasket 17 over each wireline end past the contact pin and onto the coaxial insulation layer;
16) slipping each wireline connector pin into the insulator block 15; and
17) slipping the rope socket housing 11 and rope socket cap 12 toward each other and screwing these parts together to complete the assembly.

The method of operating a wireline in conjunction with a pulley and reel associated with a drill rig, the wireline incorporating in series therewith a rope socket assembly, as defined in claim 1, includes the steps:

a) entraining the wireline on the pulley and reel,
b) operating the reel for spooling of the wireline thereon and to travel the wireline over the pulley as the pulley rotates, thereby changing the direction of wireline travel, and
c) traveling the rope socket assembly over the pulley and spooling the rope socket assembly on the reel in conjunction with the travel of the wireline over the pulley and the spooling of the wireline on the reel.

The method may also include providing divergent opposite end walls associated with and at opposite ends of the housing, and allowing the wireline to deflect into engagement with the divergent end walls as the rope socket assembly travels over the pulley and spools on the reel.

Further, the method of operation includes maintaining the rope housing assembly integral with the wireline during travel and spooling while the wireline travels uninterruptedly over the pulley and onto the reel.

We claim:

1. A rope socket assembly for making a combined electrical and mechanical connection in a wireline having an inner electrical conductor, a coaxial insulation layer about the conductor, and an outer protection wire covering about the insulation layer for survey, steering or logging use in a borehole, said wireline having opposite end portions and associated inner conductor end portions comprising:

a) a rope socket housing having a bore to receive said opposite end portions of said wireline,
b) two tubular threading plugs positioned in said bore for receiving said respective end portions of the wireline,
c) two sleeves positioned in said bore to extend about the respective plugs, and
d) an insulator block received in said bore between said sleeves, and means within said block for establishing electrical connection between said inner conductor end portions associated with said wireline end portions.

2. The assembly of claim 1 wherein each of said plugs and its associated sleeve form a space to receive end extent of a layer of coaxial insulation defined by the associated wireline end portion.

3. The assembly of claim 1 wherein said block defines an axial passage containing said means for establishing said electrical connection, said passage being in alignment with said inner electrical conductors defined by said wireline end portions.

4. The assembly of claim 3 wherein said means for establishing said electrical connection includes two contact pins for respectively establishing electrical connection with said inner electrical conductors, there being a connector extending between and electrically connecting said pins.

5. The assembly of claim 1 including said wireline opposite end portions received by said plugs.

6. The assembly of claim 2 including flange means extending in said space to receive and retain said end extent of the layer of coaxial insulation and to radially relatively position the plug and its associated sleeve.

7. The assembly of claim 6 wherein said flange means is carried by the plug.

8. The assembly of claim 7 including openings through the flange means to receive insulation strands defined by said layer of coaxial insulation.

9. The assembly of claim 1 including annular seal means for sealing off between the insulation block and said end portion of the wireline, said seal means extending about said inner conductor.

10. The assembly of claim 1 wherein said housing includes a receptacle for said plugs, sleeves and block, and an end cap having screw threaded insulation with said receptacle, to prevent endwise removal of the plugs, sleeves and block from said receptacle.

11. The assembly of claim 10 wherein the receptacle has a wall, and including retainers projecting through said wall and into interlocking relation with the sleeves and block, to prevent relative rotation of therebetween.

12. The assembly of claim 11 including annular seal means for sealing off between the insulation block and said end portion of the wire line, said seal means extending about said inner conductor.

13. The assembly of claim 10 wherein the receptacle has an inner bore surface, and said block and sleeves have a close mechanical fit with said inner bore surface.

14. The assembly of claim 10 wherein said receptacle and cap form wireline entrance ports which are axially divergent in directions away from the block.

15. The assembly of claim 10 including an axially elongated groove on the cap for engagement with an overshot tool, said groove exposed exteriorly of the receptacle.

16. The assembly of claim 8 wherein the plug has an annular convex end over which are bent insulation strands defined by said layers of coaxial insulation, the body also defining serrations against which said strands extend, for retention thereof.

17. The assembly of claim 16 wherein said sleeve has an inner flange defining an annular, concave surface facing said annular convex end of the plug, for retention of said strands that are bent back around the end of the plug.

18. The assembly of claim 4 wherein said connector is an electrically conductive tube having a bore engaged by the pins.

19. The apparatus of claim 1 wherein said insulator block is made from polyetheretherketone insulating material.

20. The apparatus of claim 4 wherein said contact pins are made from a spring material.

21. The apparatus of claim 10 wherein said rope socket housing and said rope socket cap have a radial dimensional relief at their ends to permit gradual bending of said wireline conductor external to said rope socket assembly.

22. The apparatus of claim 10 wherein said rope socket cap defines an overshot groove to permit pulling said rope socket assembly from said borehole using standard borehole retrieval equipment.

23. The method of operating a wireline in conjunction with a pulley and reel associated with a drill rig, the wireline incorporating in series therewith a rope socket assembly, as defined in claim 1, includes the steps:

a) entraining the wireline on the pulley and reel, b) operating the reel for spooling of the wireline thereon and to travel the wireline over the pulley as the pulley rotates, thereby changing the direction of wireline travel, and c) traveling said rope socket assembly over the pulley and spooling the rope socket assembly on the reel in conjunction with said travel of the wireline over the pulley and said spooling of the wireline on the reel.

24. The method of claim 23 including providing divergent opposite end walls associated with and at opposite ends of said housing, and allowing the wireline to deflect into engagement with said divergent end walls as the rope socket assembly travels over said pulley and spools on the reel.

25. The method of claim 23 wherein the said housing is provided to have overall diameter less than about 1.0 inches.

26. The method of claim 24 wherein said housing is provided to have an overall length between said divergent opposite end walls of less than 5.5 inches.

27. The method of claim 23 including maintaining the rope housing assembly integral with the wireline during said travel and spooling while the wireline travels uninterruptedly over the pulley and onto the reel.

* * * * *